US005804753A

United States Patent [19]

Speer

[11] Patent Number: 5,804,753

[45] Date of Patent: Sep. 8, 1998

[54] STRINGED INSTRUMENT

[76] Inventor: Billy L. Speer, 4779 Old Columbia Rd., Campbellsville, Ky. 42718

[21] Appl. No.: 747,495

[22] Filed: Nov. 12, 1996

[51] Int. Cl.[6] ..... G10D 1/10; G10D 3/00

[52] U.S. Cl. ..... 84/269; 84/272; 84/292; 84/315

[58] Field of Search ..... 84/269, 270, 271, 84/272, 292, 315, 319

[56] References Cited

U.S. PATENT DOCUMENTS

| | | | |
|---|---|---|---|
| 1,437,982 | 12/1922 | Luckett | 84/269 |
| 1,567,359 | 12/1925 | Wick | 84/269 |
| 1,568,248 | 1/1926 | Shutt | 84/269 |
| 1,779,972 | 10/1930 | Kremp | 84/269 |
| 2,687,057 | 8/1954 | Thompson | 84/269 |
| 3,677,125 | 7/1972 | Oliver | 84/271 |
| 3,915,049 | 10/1975 | Bean | 84/294 |
| 3,921,492 | 11/1975 | Stelling | 84/269 |
| 3,943,816 | 3/1976 | Goursau | 84/293 |
| 4,377,962 | 3/1983 | Parker | 84/269 |
| 5,033,349 | 7/1991 | Nechville | 84/272 |
| 5,355,756 | 10/1994 | Geiger . | |
| 5,431,080 | 7/1995 | Wiesenthal . | |
| 5,442,987 | 8/1995 | Davis . | |
| 5,492,045 | 2/1996 | Roblee . | |

*Primary Examiner*—Michael L. Gellner
*Assistant Examiner*—Daniel Chapik
*Attorney, Agent, or Firm*—Nixon & Vanderhye

[57] ABSTRACT

The stringed instrument includes an aluminum head formed of a stepped annular flange with a shoulder intermediate smaller and larger diameter flange portions. A groove is formed in the shoulder to enable the smaller diameter flange portion to vibrate relative to the larger diameter flange portion. A membrane is stretched over the smaller diameter flange portion. The arm of the instrument is secured solely to the larger diameter flange portion by neck mount brackets screw-threaded to the head. The brackets permit angular adjustment of the arm relative to the membrane of the head. A full fingerboard capo is slidably mounted to the neck underlying the fretboard and has an arm spring-biased to engage the strings and to maintain the capo in selected positions along the length of the arm. A fifth string capo is slidably mounted to the fretboard and has a spring to maintain it in selected longitudinal position along the fretboard.

15 Claims, 3 Drawing Sheets

STRINGED INSTRUMENT

TECHNICAL FIELD

The present invention relates to a novel and improved construction for a stringed instrument and particularly relates to a banjo construction.

BACKGROUND AND DISCLOSURE OF THE INVENTION

Stringed instruments, for example, guitars and banjos, are generally formed of a wooden construction. As such, they are difficult to set up and are susceptible to changes in their musical tone as a result of environmental changes, i.e., dampness, temperature and the like. While metal parts have been sometimes used in the construction of these instruments, that has not overcome the disadvantages of using parts which are sensitive to environmental conditions. According to the present invention, there is provided an essentially all-metal, preferably aluminum, instrument construction which eliminates those disadvantages associated with environmentally sensitive parts and enables the instrument to be constructed and set up in a manner which affords a number of unique constructional features. For example, according to the present invention, the head of the instrument comprises an annular flange which is stepped to provide a shoulder intermediate axially opposite ends of the flange. A membrane, for example, formed of a plastic material, is stretched over the end opening of the smaller diameter flange portion and margins of the membrane are secured to a ring disposed about the smaller diameter flange portion. Tension elements are disposed between the ring and the shoulder of the flange to tension the membrane across the head. The shoulder is preferably grooved to enable the smaller flange portion to vibrate and resonate relative to the larger flange portion.

Another aspect of the present invention provides for the arm of the instrument, e.g., a banjo, to be formed of all-aluminum parts, including a neck beam, a fretboard or fingerboard secured to the neck beam by screws and neck beam mounting brackets for securing the arm to the flange in a manner which enables and does not inhibit vibration of the smaller diameter flange portion relative to the larger diameter flange portion. To accomplish this, generally L-shaped mounting brackets are provided for securing the neck to the brackets. The brackets, in turn, are secured solely to the larger diameter flange portion of the head. Consequently, the arm is not attached directly to the smaller diameter flange portion whereby the vibratory action of the smaller diameter flange portion is not inhibited by attachment to any remaining portions of the instrument.

Additionally, the neck beam and fretboard are mounted relative to the neck mounting brackets in selected angular positions relative to the membrane of the head. That is, the angle of the arm can be adjusted to lie coplanar or form a slight angle with the membrane of the head as desired, thus adjusting the spacing of the strings from the head. To accomplish this, the neck beam has a pivotal connection with the neck mounting brackets. An adjusting element, e.g., a screw, passes through a slot spaced from the pivot axis of the arm whereby the neck beam and overlying fretboard can be secured in selected angular relation relative to the head.

The all-aluminum construction of the arm enables a unique construction of a full string capo as well as a fifth string capo. The full string capo includes a mounting bracket carrying screws or dovetails for reception in an elongated dovetailed groove along the side of the neck beam. The capo bracket includes a pivotally mounted arm for overlying the strings of the instrument and which arm is spring-biased into engagement with the strings of the instrument. Consequently, by sliding the capo bracket along the arm into a selected adjusted position, the arm can engage and press the strings at selected positions therealong against the fretboard.

The fifth string capo includes a mounting block having a projecting screw or dovetail received within an elongated, preferably complementary-shaped slot along the underside of the fretboard. A coil spring with two generally parallel extending ends is provided. One of the spring ends engages in the block, while the opposite spring end engages over the fifth string, the spring having sufficient biasing force to maintain the mounting block in selected adjusted position along the fingerboard.

A metal peghead is also supplied for securement by screws to the neck beam. The strings of the instrument are, of course, secured at one end to the peghead. Studs are provided in the ring about the smaller diameter flange portion of the head. The opposite ends of the strings are secured to these studs. Consequently, it will be appreciated that the construction of the instrument is substantially all-metal.

In a preferred embodiment according to the present invention, there is provided a stringed musical instrument, comprising a stepped annular flange having a shoulder intermediate opposite ends of the flange and defining a first flange portion adjacent one end of the flange smaller in diameter than the diameter of a second flange portion adjacent an end of the flange opposite the one end, a membrane disposed over an end opening of the flange defined by the first flange portion and joined to the ring, circumferentially spaced clamps about the ring and joining the ring and the flange to one another at the shoulder, the flange and the membrane defining a resonating chamber and an arm coupled to the flange and having a peghead and strings extending from the peghead over the arm and the membrane and secured to the ring.

In a further preferred embodiment according to the present invention, there is provided a stringed musical instrument, comprising a head including a generally annular flange and a membrane disposed over an end opening of the flange, the flange and the member defining a resonating chamber and the arm including a neck beam and a fingerboard connected to the neck beam, a neck beam mounting bracket for securing the neck beam and the flange to one another, the neck beam and the neck mounting bracket including a pivotal connection therebetween enabling the fingerboard and the membrane to pivot into various angular positions relative to one another and an adjusting element for releasably securing the neck beam and the neck mounting bracket into an adjusted position to maintain the fingerboard and the membrane in a selected angular position relative to one another.

In a still further preferred embodiment according to the present invention, there is provided a stringed musical instrument, comprising a head including a generally annular flange and a membrane disposed over an end opening of the flange the flange and the membrane defining a resonating chamber, an arm coupled to the flange and having a peghead and strings extending from the peghead over the arm and the membrane and secured to the head and a capo having a bar for overlying at least one string of the strings, a mounting groove along the arm, a mounting block carrying the capo for sliding movement along the arm into selected adjusted positions therealong and a spring for securing the capo in selected adjusted position along the arm and maintaining the bar overlying at least one string.

Accordingly, it is a primary object of the present invention to provide a novel and improved substantially all-metal stringed instrument, e.g., a banjo.

BEST MODE FOR CARRYING OUT THE INVENTION

Figure 1:
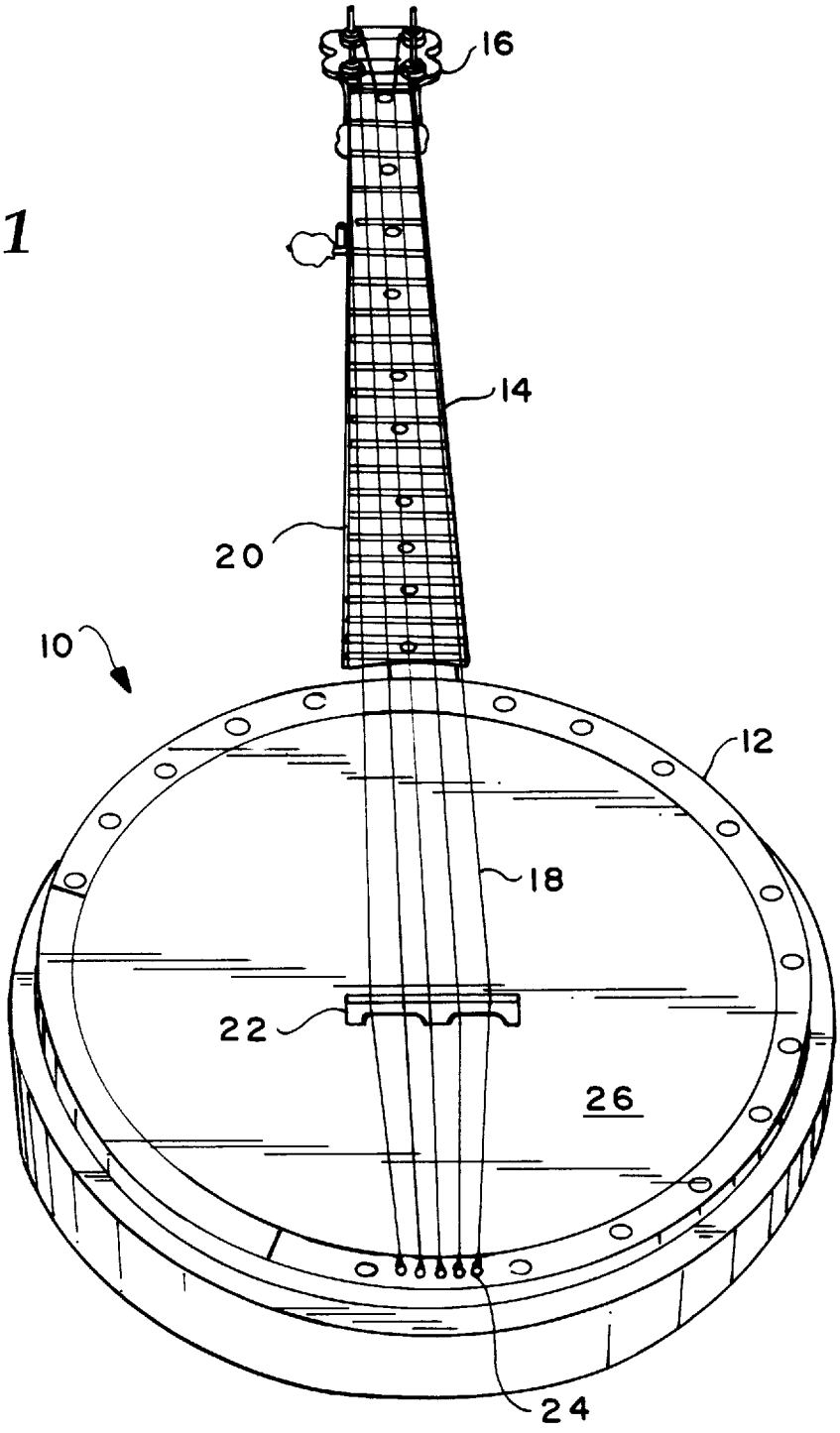
FIG. 1 is a perspective view of a stringed instrument constructed in accordance with the present invention.

Referring now to the drawings, particularly to FIG. 1, there is illustrated a string musical instrument, generally designated 10, and including a head 12, an arm 14, a peghead 16 for securing one end of the strings 18 of the instrument, a fingerboard 20, a bridge 22 and studs 24 for securing the opposite ends of the strings to the head 12. It will be appreciated that the head 12 includes a membrane 25 stretched over the face of head 12 and underlying the strings.

Figure 2:
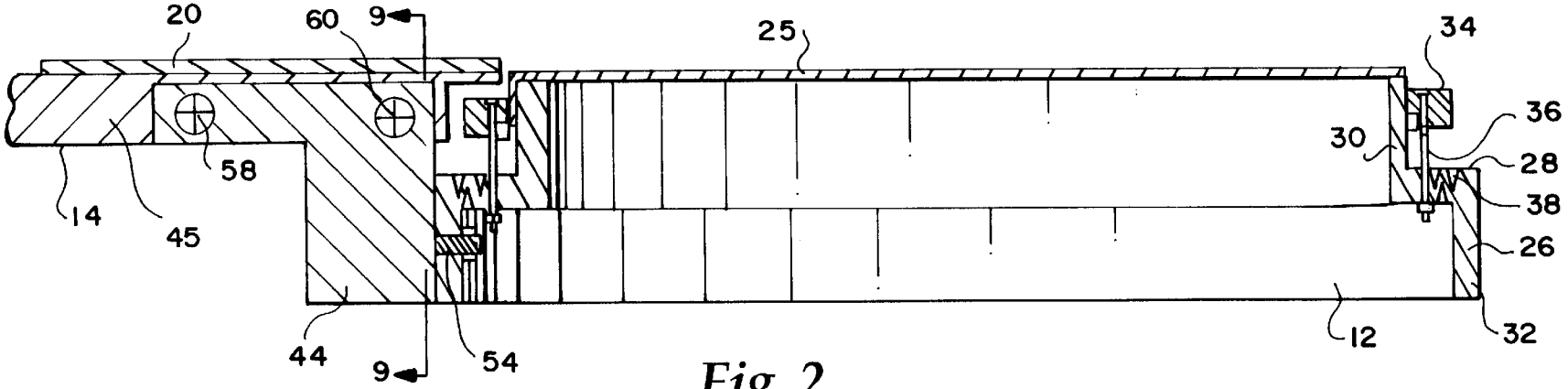
FIG. 2 is a fragmentary longitudinal cross-sectional view through the head, neck mounting bracket and arm of the string musical instrument according to the present invention.
Figure 5:
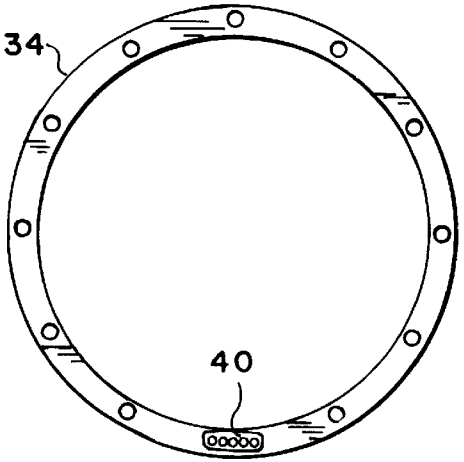
FIG. 5 is a top plan view of the ring surrounding the flange.
Figure 4:
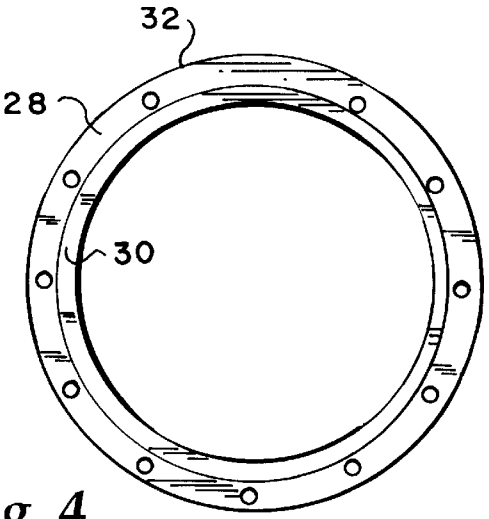
FIG. 4 is a top plan view of the flange.
Figure 3:
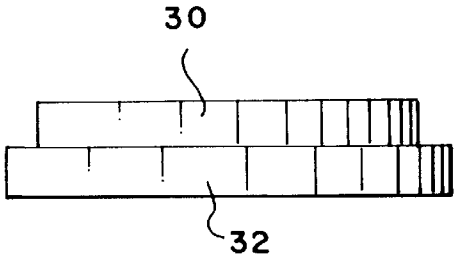
FIG. 3 is a reduced side elevational view of the head or flange of the instrument.

Referring now to FIG. 2, head 12 comprises an annular flange 26 formed of metal, preferably aluminum, and which flange is stepped intermediate its opposite ends to provide an annular shoulder 28 facing in an axial direction and small and large diameter flange portions 30 and 32, respectively, on opposite sides of shoulder 28. As illustrated in FIG. 2, the membrane 25 is stretched across the open end of the smaller diameter flange portion 30. The margins of the membrane 25 are secured to a ring 34 which surrounds the smaller diameter flange portion 30. The ring 34 is secured by tension clamps or bolts 36 which are received through circumferertially spaced openings about the ring 34 and the shoulder 28. Suitable nuts are provided along the underside of the shoulder to secure the bolts to the flange 26. At least one groove and preferably a plurality of grooves 38 are formed in the shoulder 28 to enable the smaller diameter flange portion 30, and hence membrane 25, to vibrate independently of the larger diameter flange portion 32. It will be appreciated from the ensuing description that the smaller diameter flange portion 30 and shoulder 28 are not structurally connected to any other part of the stringed instrument other than through the large diameter flange portion 32. The ring 34, illustrated in FIG. 5, also carries a plurality of studs 40 to which are mounted one end of the strings 18 of the instrument.

Figure 9:
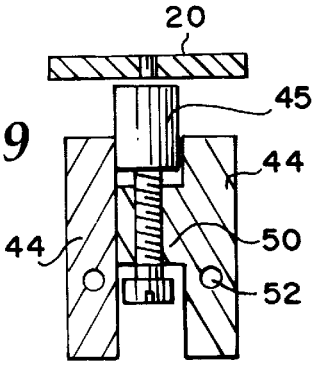
FIG. 9 is an enlarged cross-sectional view taken generally about on lines 9—9 in FIG. 2.
Figure 10:
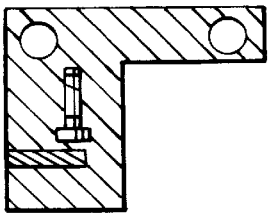
FIG. 10 is a cross-sectional view of one of the neck mounting brackets.

From a review of the drawing figures, particularly FIG. 2, it will be appreciated that the arm 14 is comprised of the fretboard or fingerboard 20 releasably secured to an underlying neck beam 45 which, in turn, is releasably secured to the larger diameter flange portion 32 of head 12 by neck mounting brackets 44. These parts, similar to the flange and ring, are formed of metal, preferably aluminum. The metal fretboard 20 is preferably screwed to the neck beam 44. To secure the arm 14 to the head 12, a pair of neck mounting brackets 44 are provided. Brackets 44 are generally L-shaped in side elevation and one of the brackets 44*a* includes a laterally directed flange 50 as illustrated in FIGS. 9 and 10. Female threaded openings 52 are provided along the back side of each common leg of the brackets 44 for threadedly receiving studs 54, the opposite ends of which are threadedly received in female threaded openings in the side of the enlarged diameter flange portion 32. The studs form the sole structural connection between the neck beam mounting brackets 44 and the flange 12, hence the head. It will be appreciated from a review of FIG. 2 that the neck beam mounting brackets are spaced from the shoulder 28 and the smaller diameter flange portion 30.

Figure 8:
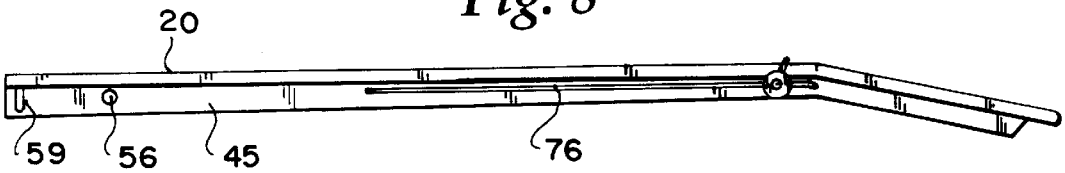
FIG. 8 is a side elevational view thereof.

It is also a feature of the present invention that the arm 14 can be secured to the head 12 at selected angular positions so that the fretboard 20 may lie generally parallel to or at a slightly offset and adjusted angle relative to the membrane 25. To accomplish this, the neck beam 45, as illustrated in FIGS. 2 and 9, is disposed between the neck beam mounting brackets 44. As illustrated in FIG. 8, neck beam 45 includes a transverse opening 56 which serves as a pivot point for a screw 58 (FIG. 2) passing through transversely aligned screw openings of the neck mounting brackets 44. The neck beam 45 also includes a vertically extending elongated slot 59 adjacent its end for receiving a screw 60 also extending through aligned transversely extending openings of the neck beam mounting brackets 44. It will be seen, therefore, that the arm can be pivoted about the screw 58 and maintained in a selected adjusted angular position relative to the head 12 by a tightening of the screw 60 in the elongated slot 59.

Figure 6:
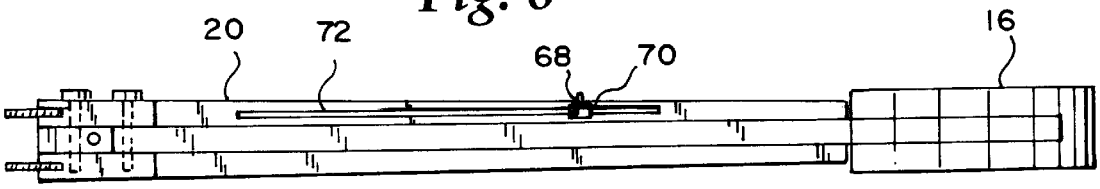
FIG. 6 is a bottom plan view of the arm and peghead and illustrating the connecting studs to the head.
Figure 6A:
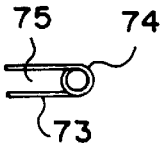
FIG. 6A is an elevated view of the spring for the fifth string capo.

Referring now to FIGS. 6 and 6A, there is disclosed a fifth string capo 68. According to the present invention, the fifth string capo includes a mounting block 70 having an upwardly projecting screw head or dovetail for reception in an elongated slot 72 along the underside of the fretboard, the slot 72 preferably also having a dovetail configuration, whereby the mounting block 70 is mounted for sliding movement longitudinally along the arm. A coil spring 74, illustrated in FIG. 6A, has generally parallel free ends with one free end 73 disposed in an opening in the mounting block 70. The opposite free end 75 comprises a bar disposed above the fretboard and overlying the fifth string of the instrument. It will be appreciated that the mounting block 70 is slidable along the slot 72 with the tension of the spring maintaining the block in an adjusted longitudinal position along the length of the arm, the upper spring end 77 overlying the fifth string and serving as the fifth string capo.

Figure 11:
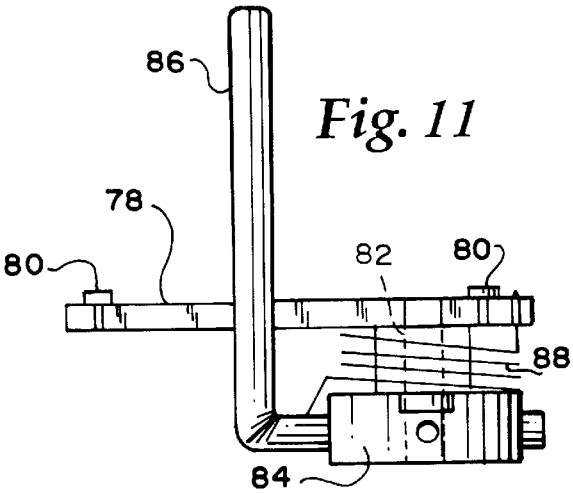
FIG. 11 is an enlarged top plan view of a full capo for mounting on the arm of the instrument.

The instrument according to the present invention also includes a full fingerboard capo which is slidable into selected adjusted positions along the length of the arm. To accomplish this, the side of the neck beam 45 is provided with a longitudinally extending, preferably dovetail-shaped slot 76 (FIG. 8). As illustrated in FIG. 11, a full fingerboard capo mounting bracket 78 includes a pair of dovetails 80 along its inside face for reception in the complementary-shaped dovetail slot 76 whereby the full fingerboard capo is slidable longitudinally along the arm of the instrument. Projecting laterally from the bracket 78 is a pin 82 on which is pivotally mounted a cylindrical head 84 carrying a bar 86 for overlying the strings of the instrument. A coil spring 88 extends between the bracket 78 and the cylindrical head 84 and biases the arm 86 for rotation into a position engaging the strings of the instrument against the fretboard 20. By displacing the arm 86 against the bias of coil spring 80, the bracket 78 is slidable along the arm into an adjusted position whereupon release of the arm 86 enables the coil spring 88 to engage the arm 86 against the strings and the fretboard 20, as well as maintain the full fingerboard capo in the selected adjusted position along the arm.

Figure 7:
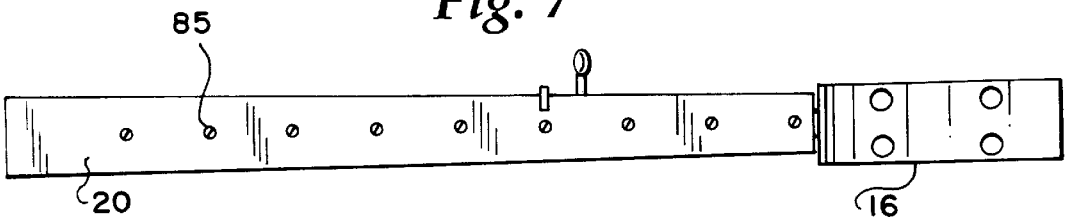
FIG. 7 is a top plan view of a fingerboard and peghead for securement to the neck beam.

As illustrated in FIGS. 6 and 7, the peghead 16 is similarly screwed to the underlying neck beam 45 by a series of spaced screws 85. The peghead, of course, carries studs to which one end of the strings is secured. The opposite ends of the strings are secured to the studs 40 of the ring 34.

It will be appreciated that, with the exception of the bridge and frets on the fretboard, the stringed instrument hereof is essentially of all-metal, preferably aluminum, construction. As a consequence, the instrument is easy to set up and does not alter its initial set up as a result of changing environmental conditions, i.e., dampness, temperature and the like.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stringed musical instrument, comprising:

a stepped annular flange having a shoulder intermediate opposite ends of said flange and defining a first flange portion adjacent one end of the flange smaller in diameter than the diameter of a second flange portion adjacent an end of said flange opposite said one end;

a ring about said first flange portion;

a membrane disposed over an end opening of the flange defined by said first flange portion and joined to said ring;

circumferentially spaced clamps about said ring and joining said ring and said flange to one another at said shoulder;

said flange and said membrane defining a resonating chamber;

said shoulder connecting said first flange portion and said second flange portion to one another enabling said first flange portion to vibrate substantially independently of said second flange portion; and an arm coupled to said second flange portion and having a peghead and strings extending from said peghead over said arm and said membrane and secured to said ring.

2. An instrument according to claim 1 wherein said shoulder has at least one groove therein to facilitate said vibration of said first flange portion independently of said second flange portion.

3. An instrument according to claim 1 wherein said arm includes a neck beam and a fingerboard secured to said neck beam, a neck beam mounting bracket for connecting said neck beam and said fingerboard to said flange, said bracket being secured to said larger diameter flange portion and constituting the sole securement between said second flange portion and said arm whereby said smaller diameter flange portion is substantially free for vibration relative to said larger diameter flange portion.

4. An instrument according to claim 3 wherein said neck beam mounting bracket includes a pair of elements spaced laterally from one another and clamping said neck beam therebetween.

5. An instrument according to claim 1 including a full fingerboard capo having a capo bar for overlying said strings, a slot formed along said arm, a mounting bracket engaged in said slot and carrying said capo bar and a spring for biasing said bar against the strings and fingerboard for releasably securing said capo in selected adjusted positions along said arm, said capo bar extending from said bracket from one side of said arm and overlying said strings and fingerboard terminating in a free unsupported end opposite another side of said arm.

6. An instrument according to claim 1 including a fifth string capo having a bar for overlying a fifth string of said strings, a mounting groove along said arm, a mounting block carrying said fifth string capo for sliding movement along said arm into selected adjusted positions therealong and a spring for securing said fifth string capo in selected adjusted position along said arm and maintaining said bar overlying the fifth string.

7. An instrument according to claim 1 wherein said arm includes a neck beam and a fingerboard overlying said neck beam, said neck beam and said fingerboard being formed of aluminum and secured to one another by screws.

8. An instrument according to claim 1 wherein said arm includes a neck beam and a fingerboard connected to said neck beam, a neck beam mounting bracket for securing said neck beam and said second flange portion to one another, said neck beam and said neck mounting bracket including a pivotal connection therebetween enabling said fingerboard and said membrane to pivot into various angular positions relative to one another and an adjusting element for releasably securing said neck beam and said neck mounting bracket into an adjusted position to maintain said fingerboard and said membrane in a selected angular position relative to one another.

9. An instrument according to claim 1 wherein said flange, said ring and said arm are formed of aluminum.

10. An instrument according to claim 5 wherein said capo bar is pivotally carried by said mounting bracket, said spring biasing said capo bar into releasable engagement with said strings.

11. An instrument according to claim 1 wherein said arm is pivotally coupled to said second flange portion, enabling said first flange portion to vibrate without interference by the pivotal coupling between said flange and said arm.

12. An instrument according to claim 1 wherein said shoulder has a plurality of grooves therein forming adjacent thick and thin shoulder portions to facilitate vibration of said first flange portion independently of said second flange portion.

13. A stringed musical instrument, comprising:

a head including a generally annular flange and a membrane disposed over an end opening of the flange, said flange and said member defining a resonating chamber; and said arm including a neck beam and a fingerboard connected to said neck beam, strings connected between said flange and said arm and overlying said fingerboard, a neck beam mounting bracket for securing said neck beam and said flange to one another, said neck beam and said neck mounting bracket including a pivotal connection therebetween enabling said fingerboard and said membrane to pivot into various angular positions relative to one another and an adjusting element for releasably securing said neck beam and said neck mounting bracket in an adjusted position to maintain said fingerboard and said membrane in a selected angular position relative to one another, a full fingerboard capo having a bar for overlying said strings, a slot formed along said arm, a mounting bracket engaged in said slot and carrying said capo bar, and a spring for biasing said bar against the strings and fingerboard for releasably securing said capo in selected adjusted positions along said arm, said capo bar extending from said bracket from one side of said arm and overlying said strings and fingerboard terminating in a free unsupported end opposite another side of said arm.

14. An instrument according to claim 13 including a fifth string capo having a bar for overlying a fifth string of said strings, a mounting groove along said arm, a mounting block carrying said fifth string capo for sliding movement along said arm into selected adjusted positions therealong and a spring for securing said fifth string capo in selected adjusted position along said arm and maintaining said bar overlying the fifth string.

15. An instrument according to claim 13 wherein said arm includes a neck beam and a fingerboard overlying said neck beam, said neck beam and said fingerboard being formed of aluminum and secured to one another by screws.

* * * * *